United States Patent [19]

Steele

[11] 4,393,276

[45] Jul. 12, 1983

[54] FOURIER MASKING ANALOG SIGNAL SECURE COMMUNICATION SYSTEM

[75] Inventor: Raymond Steele, Hazlet, N.J.

[73] Assignee: Bell Telephone Laboratories, Incorporated, Murray Hill, N.J.

[21] Appl. No.: 245,627

[22] Filed: Mar. 19, 1981

[51] Int. Cl.[3] ..... H04K 9/00

[52] U.S. Cl. ..... 179/1.5 R; 179/1.5 M; 178/22.13

[58] Field of Search ..... 179/1.5 R, 1.5 M; 178/22.11, 22.13, 22.10

[56] References Cited

U.S. PATENT DOCUMENTS

| | | | |
|---|---|---|---|
| 3,688,193 | 8/1972 | McDonald | 179/1.5 M |
| 3,959,592 | 5/1976 | Ehrat | 179/1.5 R |
| 4,052,565 | 10/1977 | Baxter et al. | 179/1.5 R |
| 4,086,435 | 4/1978 | Graupe et al. | 179/1.5 R |
| 4,100,374 | 6/1978 | Jayant et al. | 179/1.5 R |
| 4,126,761 | 11/1978 | Graupe et al. | 179/1.5 R |
| 4,200,770 | 4/1980 | Hellman et al. | 178/22.11 |

FOREIGN PATENT DOCUMENTS

| | | | |
|---|---|---|---|
| WO81/02234 | 8/1981 | PCT Int'l Appl. | 179/1.5 R |

OTHER PUBLICATIONS

Electronic Design, vol. 9, (4/26/79) pp. 78–85 Schrim.
IEEE Trans. on Info. Theory, vol. IT-25, No. 3 (5/79) pp. 261–274, Wyner Analog Scrambing that does not Expand Bandwidth.
Electronics, (6/21/79), pp. 107–120 Hindin, LSI-Based Data Enoryption Discourages Data Thief.
IEEE Trans. on Info. Theory, vol. IT-25, No. 4 (7/79) pp. 415–425 Wyner (II).

*Primary Examiner*—Sal Cangialosi
*Attorney, Agent, or Firm*—Erwin W. Pfeifle

[57] ABSTRACT

The present invention relates to a secure communication system for analog signals which preserves the bandwidth of the original message signal by employing scrambling, or masking, techniques in the frequency domain instead of the time domain. At the transmitting end, the message signal $x_a(t)$ is sequentially passed through a Fourier transform processor (12) and a scrambling arrangement (14) before being masked to form a secure Fourier transform sequence $X_s(n)$. The secure message signal $x_s(t)$ is formed by passing the secure sequence $X_s(n)$ through an inverse Fourier transform processor (16) which produces a secure signal $x_s(t)$ comprising the same bandwidth as the original message signal $x_a(t)$. At the receiving end, the secure signal $x_s(t)$ is passed through a Fourier transform processor (22) and a descrambling arrangement (24) which performs the conjugate operation of the above-described scrambling arrangement, and "un-masks" the secure Fourier transform to reform the original Fourier transform $X_a(n)$. The original message signal $x_a(t)$ is recovered by passing the Fourier transform $X_a(n)$ through an inverse Fourier transform processor (26).

11 Claims, 6 Drawing Figures

10
12
F
14
SCRAMBLER
16
I/F
20
22
F
24
DESCRAMBLER
26
I/F
$x_a(t)$
$X_a(n)$
$X_s(n)$
$x_s(t)$

12
F
30
I/T
31
FFT
14
SCRAMBLER
32
SELECTOR $N_s<N$
33
M-LEVEL QUANT
34
M-LEVEL QUANT
36
MASKING CIRCUIT
37
INSERTER
16
I/F
38
IFFT
39
WEIGHTING CIRCUIT
$x_a(t)$
$x(n)$
$X_R(n)$
$X_I(n)$
$X_a(n)$
$\bar{X}_R(n)$
$\bar{X}_I(n)$
$Q_R(n)$
$Q_I(n)$
$Q'_R(n)$
$Q'_I(n)$
$\bar{Q}'_R(n)$
$\bar{Q}'_I(n)$
$X_s(n)$
$x_s(t)$ n
N
N/2
$X_I(n)$
$X_R(n)$
0
1
2 n
N
N/2
$\bar{X}_I(n)$
$\bar{X}_R(n)$
0
1
2

FOURIER MASKING ANALOG SIGNAL SECURE COMMUNICATION SYSTEM

BACKGROUND OF THE INVENTION

1. Field of the Invention

The present invention relates to a secure analog signal communication system, and more particularly to a Fourier masking analog signal communication system which preserves the bandwidth of the original signal by performing the masking operation in the frequency domain.

2. Description of the Prior Art

In order to provide privacy in a communication system, apparatus is used that renders an analog communication signal unintelligible by altering or "scrambling" the signal in a prearranged way. The intended receiving party uses apparatus to descramble the signal and recover the transmitted information easily while any unintended receiving party experiences considerable difficulty in doing so. Such apparatus finds utility in the field of military, police or other official communications and in the field of civilian communications such as provided by the domestic telephone system. Throughout the following description, the analog communication signal is assumed to be speech, and the communication channel is assumed to be a telephone channel, although it will be understood that wider application of these techniques is envisioned and may include virtually any analog signal and any communication channel having limited bandwidth.

Speech scrambling is provided in the prior art in two basically dissimilar ways, digital scrambling and analog scrambling, where digital scrambling has the potential for providing a greater degree of security than analog scrambling. An exemplary digital scrambling system is disclosed in U.S. Pat. No. 4,052,565 issued to D. D. Baxter et al on Oct. 4, 1977, which relates to a digital speech scrambler system for the transmission of scrambled speech over a narrow bandwidth by sequence limiting the analog speech in a low-pass sequence filter and thereafter multiplying the sequence limited speech with periodically cycling sets of Walsh functions at the transmitter. At the receiver, the Walsh scrambled speech is unscrambled by multiplying it with the same Walsh functions previously used to scramble the speech. The unscrambling Walsh functions are synchronized to the received scrambled signal so that, at the receiver multiplier, the unscrambling Walsh signal is identical to and in phase with the Walsh function which multiplied the speech signal at the transmitter multiplier.

There is, however, a substantial increase in bandwidth of a digital scrambling system as disclosed hereinabove, which is especially disadvantageous when employed in a practical transmission system such as a telephone system. For example, a sampling rate of 8000 samples per second is suitable for a 3.5 KHz speech signal, where for eight-bit samples this rate results in a potential scrambled signal bit rate of 65 Kbps. Therefore, for transmission over a telephone channel this scrambling signal bit rate will require a bandwidth considerably in excess of 3.5 KHz. Alternatively, techniques may be employed to reduce the required bandwidth to 3.5 KHz, but these techniques introduce unwanted distortion and will result in a loss of fidelity.

In contrast, analog scrambling is limited in bandwidth to the bandwidth of the original signal. Thus, a 3.5 KHz telephone speech signal will occupy approximately 3.5 KHz in scrambled form and can be transmitted over ordinary telephone lines without the necessity for additional bandlimiting of the scrambled signal. One known technique for achieving analog scrambling of speech signals is disclosed in U.S. Pat. No. 4,126,761 issued to D. Graupe et al on Nov. 21, 1978. As disclosed therein, an input audio frequency analog signal, as for example, speech, which is to be passed through a noisy transmission channel, is scrambled at the sending end by repetitively performing a modulo-$\nu$ (MOD $\nu$) addition of an n-level, m-pulse codeword with an n-level digitized transformation of the input signal under the condition that m and $\nu$ are integers. Descrambling is achieved by carrying out a MOD $\nu$ subtraction process involving repetitively subtracting the same code word from an n-level digitized transformation of the received signal, the subtraction being carried out in synchronism with the addition at the sending end. The resultant difference signal is a representation of the input signal and is relatively insensitive to noise present in the transmission channel. Synchronization is achieved by providing for the codeword to be shifted, at the receiving end, forwardly or backwardly, by an appropriate number of discrete intervals until intelligibility is achieved. Thus, synchronization is achieved by relying on the contents of the received signal.

The disadvantage of analog scrambling, however, is the limited security offered. Because of the complexity and precision required by the circuitry employed, a determined interceptor may find it straightforward to descramble the intercepted signal by exhaustively trying all possible combinations of scrambling variables.

It has, therefore, been a problem in the prior art to provide a scrambling system that has the advantage of the high security afforded by digital scrambling without expanding the bandwidth of the scrambled signal and thus either requiring a broadband communication channel or inducing distortion and loss of fidelity. Restated, the problem is to provide a secure analog speech scrambling system.

SUMMARY OF THE INVENTION

The problem remaining in the prior art has been solved in accordance with the present invention, which relates to a secure analog signal communication system, and more particularly, to a Fourier masking analog signal communication system which preserves the bandwidth of the original signal by performing the masking operation in the frequency domain.

It is an aspect of the present invention to provide secure analog scrambling by first performing a Fourier transform on the input signal. The real and imaginary Fourier coefficients obtained therefrom are then quantized and masked to form decorrelated and statistically independent frequency samples. Thus, performing the scrambling in the frequency domain instead of the time domain, as was done in the prior art, allows the bandwidth of the scrambled signal to remain virtually identical to that associated with the original signal.

It is to be understood that the use of the term "secure" in association with the present invention is not intended to imply "unbreakable", but rather is used to define a level of security which is at the very least comparable to the security obtained by employing any of the prior art techniques of signal scrambling.

Other and further aspects of the present invention will become apparent during the course of the following description and by reference to the accompanying drawings.

BRIEF DESCRIPTION OF THE DRAWING

Referring now to the drawings, in which like numerals represent like parts in several views.

DETAILED DESCRIPTION

Figure 1:
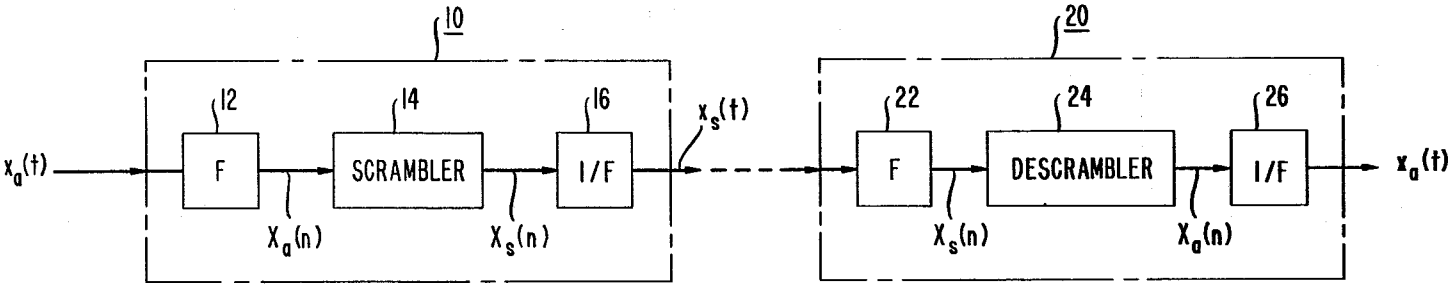
FIG. 1 illustrates a secure system for transmitting and receiving signals employing Fourier transform techniques in accordance with the present invention.

A communication system capable of transmitting and receiving a secure analog signal is illustrated in general form in FIG. 1, where the individual system components are described in greater detail hereinafter in the discussion associated with FIGS. 2-6. In general, an analog message signal $x_a(t)$ enters a scrambling arrangement 10, as illustrated in FIG. 1 and further detailed in FIG. 2, and is therein transformed into a secure analog signal $x_s(t)$ which comprises approximately the same bandwidth as the original message signal $x_a(t)$. Scrambling arrangement 10 comprises, in cascaded form, a Fourier transform processor 12, a scrambler 14, and an inverse Fourier transform processor 16, where these components sequentially function to transform the message signal $x_a(t)$ into its associated Fourier sequence $X_a(n)$, scramble the components of this sequence to form a secure Fourier sequence $X_s(n)$, and lastly, inverse Fourier transform the secure Fourier sequence into the secure time domain signal $x_s(t)$, the signal transmitted by arrangement 10.

After traveling through the communication medium, the original message signal $x_a(t)$ is recovered from the transmitted secure signal $x_s(t)$ through a descrambling arrangement 20 as illustrated in FIG. 1. Descrambling arrangement 20 is similar in form to scrambling arrangement 10, comprising in cascade form a Fourier transform processor 22, a descrambler 24 and an inverse Fourier transform processor 26, which function sequentially to transform the secure signal $x_s(t)$ into its associated Fourier sequence $X_s(n)$, descramble this sequence to reform the original Fourier sequence $X_a(n)$, and lastly, inverse Fourier transform the original Fourier sequence into the original time domain message signal $x_a(t)$. It will be assumed for the purposes of discussion of the present invention that all signal paths are ideal channels, thereby allowing descrambling arrangement 20 to recover the exact message signal $x_a(t)$. It is to be understood, however, that in implementation of the present invention in association with non-ideal channels, signal distortion may result, where such distortion may be significantly alleviated by employing any of the well-known channel equalization techniques, thereby allowing descrambling arrangement 20 to recover a very close approximation of message signal $x_a(t)$.

Figure 2:
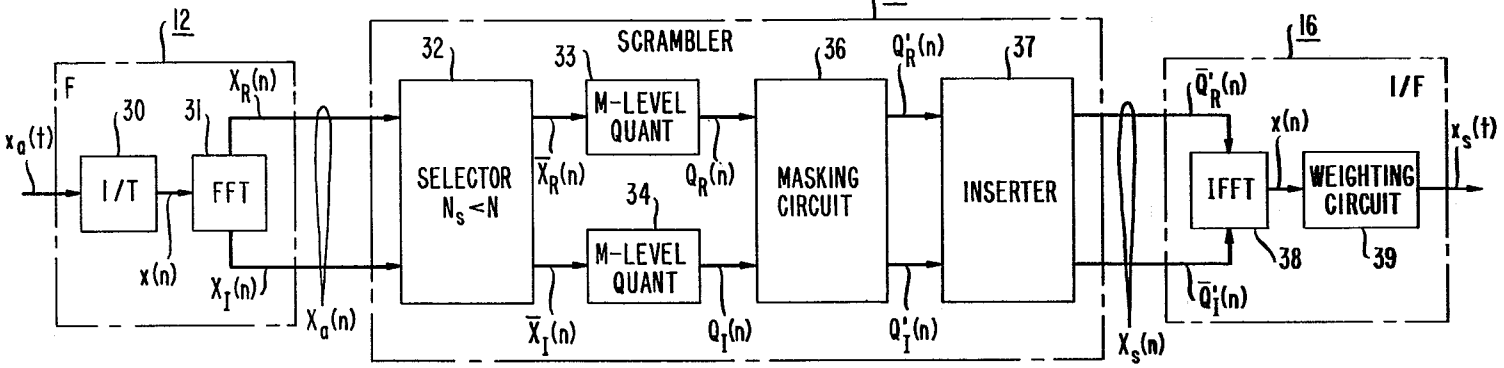
FIG. 2 contains a preferred embodiment of an exemplary scrambling arrangement which may be employed in the system of FIG. 1 in accordance with the present invention.

An exemplary scrambling arrangement 10 of the system shown in FIG. 1, which is formed in accordance with the present invention, is illustrated in detail in FIG. 2. In this exemplary arrangement, an analog input message signal $x_a(t)$ is applied to Fourier transform processor 12, which comprises in series a sampling circuit 30 and a fast Fourier transformer (FFT) 31. Sampling circuit 30 samples the input signal $x_a(t)$ at a rate of 1/T to produce an output sequence $x(n)=x_a(nT)$. A block of N samples of the sequence x(n) is subsequently applied as an input to fast Fourier transformer 31, where transformer 31, as is wellknown in the art, may be implemented with LSI devices. An example of one such LSI implementation is discussed in the article "Get to Know the FFT and Take Advantage of Speedy LSI Building Blocks" by L. Schirm IV, appearing in *Electronic Design,* Vol. 9, April 29, 1979 at pp. 78-85.

Figure 3:
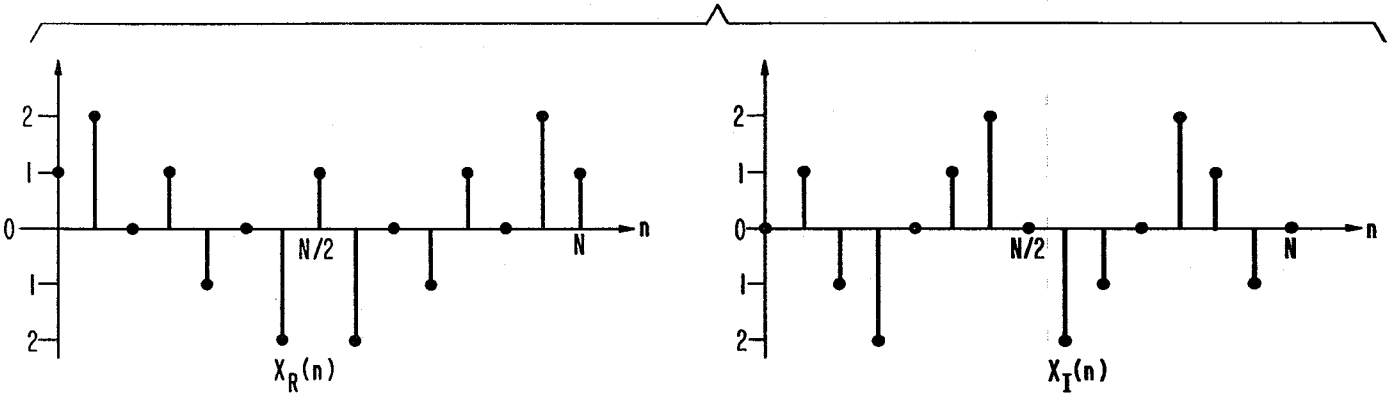
FIG. 3 illustrates an exemplary N-point fast Fourier transform for the value N=16, depicting the even and odd symmetry properties of these transforms, where these properties are employed in conjunction with the preferred embodiments of FIGS. 2 and 6.
Figure 4:
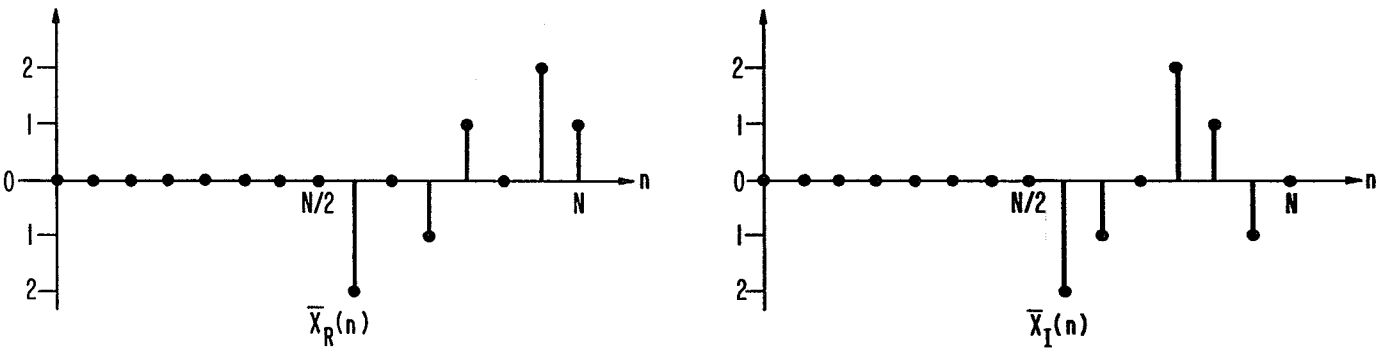
FIG. 4 contains truncated versions of the transforms illustrated in FIG. 3.

In accordance with the known symmetry properties of the FFT algorithm, the output sequence $X_a(n)$ produced by fast Fourier transformer 31 comprises two distinct sequences, each containing N coefficients, or elements. More particularly, $X_a(n)$ is the complex sum of an N-length real sequence, $X_R(n)$, evenly symmetric about the value N/2, and an N-length imaginary sequence, $X_I(n)$, oddly symmetric about the value N/2. Examples of such sequences for the value N=16 are illustrated in FIG. 3. As can be seen by reference to FIG. 3, even sequences are characterized by the relation $X_R(N/2-n)=X_R(N/2+n)$, for all values of n, and odd sequences are characterized by the relation $X_I(N/2-n)=-X_I(N/2-n)$. Thus, for the value N=16, the last eight elements of each sequence are redundant, containing the same information as the first eight elements.

In accordance with the system illustrated in FIG. 1, the output of processor 12, in this example sequences $X_R(n)$ and $X_I(n)$, are applied as separate inputs to scrambler 14. An exemplary scrambler 14, as shown in detail in FIG. 2, comprises in a cascade arrangement a coefficient selector 32, a pair of quantizers 33 and 34, a masking circuit 36, and a coefficient inserter 37, where quantizers 33 and 34 are in the real and imaginary output paths, respectively, of selector 32, and have their outputs coupled to separate inputs of masking circuit 36.

In the operation of scrambler 14, the real and imaginary sequences $X_R(n)$ and $X_I(n)$ forming $X_a(n)$, which are generated by fast Fourier transformer 31, are applied as separate inputs to coefficient selector 32 which selects a subset $N_s$ of each set of N coefficients, where only the subset $N_s$ is employed in further signal processing in accordance with the present invention. Specifically, selector 32 deletes, for example, the first N/2 coefficients from each sequence, leaving the sequences, denoted $X_R(n)$ and $X_I(n)$, respectively, in the form illustrated in FIG. 4. As seen by reference to FIG. 4, although each sequence contains only N/2 elements, no information is lost in accordance with the above-described symmetry properties of $X_R(n)$ and $X_I(n)$, as illustrated in FIG. 3. Further, certain classes of signals are known to contain little or no information in certain frequency bands, and the coefficients related thereto may also be deleted by selector 32 with no loss in output signal fidelity. For example, speech is bandlimited to the range of approximately 300 Hz–3.4 KHz, and any coefficient related to frequencies below 300 Hz or above 3.4 KHz may therefore be ignored without loss of signal information. An exemplary selector 32 may be implemented, for example, with a microprocessor which is programmed to: (a) read and store the sequences $X_R(n)$ and $X_I(n)$, (b) re-write the last N/2 elements of each sequence into a separate one of a pair of temporary files, and (c) produce as an output the nonzero members of the temporary files, which will be the sequences $X_R(n)$ and $X_I(n)$, respectively. Selector 32, therefore, produces as an output a first and a second sequence of real and imaginary coefficients, $X_R(n)$ and $X_I(n)$, respectively, each containing $N_s$ elements, where $N_s \leqq N/2$.

In accordance with the present invention, the $N_s$-length sequences $X_R(n)$ and $X_I(n)$ produced by selector 32 are subsequently applied as inputs to M-level quantizers 33 and 34, respectively, which have their quantization levels sequentially numbered from the most negative, denoted level number 0, to the most positive, in this case, level number M-1. In one exemplary form, quantizers 33 and 34 may be implemented with a ROM (read-only memory), which, as is well-known in the art, functions as a "look-up" table. In this case, the Fourier coefficients, real and imaginary, are applied as inputs to quantizers 33 and 34, respectively, to "look-up" their associated level number, where the sequences of level numbers form the output of quantizers 33 and 34. If the analog input message signal to the system, $x_a(t)$, possesses known statistical properties, the mapping function of quantizers 33 and 34 (Fourier coefficient→level number) may be adjusted accordingly. For example, if the analog input signal $x_a(t)$ is speech, the frequency bands associated with the level numbers 0 through M-1 will be non-linearly distributed using a suitable companding law related to the known interdependence of speech signals.

The $N_s$-length sequences of level numbers generated by quantizers 33 and 34, denoted $Q_R(n)$ and $Q_I(n)$, which are related to the $N_s$-length sequences $X_R(n)$ and $X_I(n)$, respectively, are subsequently applied as separate inputs to masking circuit 36 which will independently scramble each sequence to form its associated secure $N_S$-length sequence. For example, if $N_s=4$, $M=8$, $Q_R(n)=\{7,1,5,2\}$ and $Q_I(n)=\{3,3,6,4\}$, the output sequences of masking circuit 36, denoted $Q'_R(n)$ and $Q'_I(n)$, may be the sets $\{2,1,7,5\}$ and $\{3,4,3,6\}$, respectively.

Figure 5:
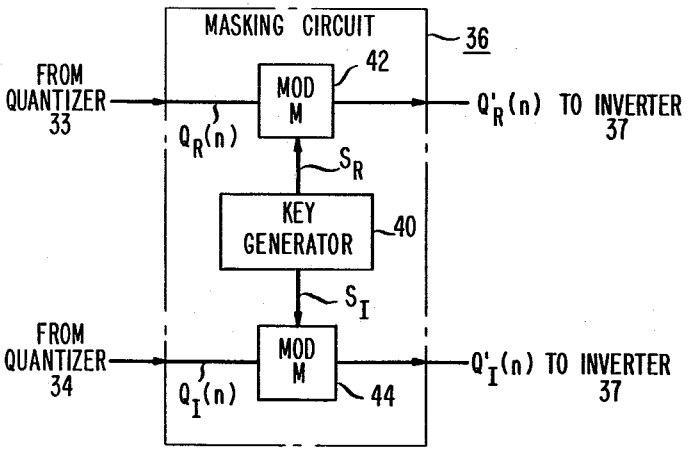
FIG. 5 illustrates an exemplary masking (i.e., scrambling) arrangement which may be employed in accordance with the present invention.

An exemplary masking circuit 36 which may be employed in the scrambling arrangement of FIG. 2 is illustrated in FIG. 5. As shown in FIG. 5, masking circuit 36 includes a key generator 40 which produces a pair of $N_s$-length masking sequences $S_R$ and $S_I$, which comprise elements of value in the range 0 through M-1. Both sequences $S_R$ and $S_I$ must be randomly generated sequences in order to provide secure communication in accordance with the present invention. An exemplary circuit arrangement capable of generating such sequences to be used in the above-described scrambling circuit is described in the article "LSI-based Data Encryption Discourages the Data Thief" by H. J. Hindin, appearing in Electronics, June 21, 1979 at pp. 107–119.

As seen in FIG. 5, the $N_S$-length sequence $S_R$ produced by key generator 40 and the $N_S$-length quantized real sequence $Q_R(n)$ produced by quantizer 33 of FIG. 2 are applied as inputs to a first modulo-M adder 42, where the corresponding elements of each sequence are modulo-M added together. That is, the first element of $S_R$ is modulo-M added to the first element of $Q_R(n)$, the second element of $S_R$ to the second element of $Q_R(n)$, and likewise, with the $N_S$-th element of $S_R$modulo-M added to the $N_S$-th element of $Q_R(n)$. The $N_S$-length output sequence produced by adder 42, the modulo-M sum of $S_R$ and $Q_R(n)$ denoted $Q'_R(n)$, is, in accordance with the random properties of $S_R$, a decorrelated and statistically independent scrambled (i.e., secure) version of $Q_R(n)$. In a like manner, $N_S$-length sequence $S_I$ produced by key generator 40 and the quantized imaginary sequence $Q_I(n)$ produced by quantizer 34 of FIG. 2, are applied as separate inputs to a second modulo-M adder 44 and subjected to the same modulo-M addition procedure as that described above in association with adder 42. In a like manner, the $N_S$-length output sequence produced by adder 44, the modulo-M sum of $S_I$ and $Q_I(n)$ denoted $Q'_I(n)$, is a decorrelated and statistically independent scrambled version of $Q_I(n)$ in accordance with the random properties of $S_I$. Therefore, the scrambling of an analog input signal $x_a(t)$, via quantized Fourier sequences $Q_R(n)$ and $Q_I(n)$, is achieved by masking, not in the time domain which expands bandwidth, but in the frequency domain where no such bandwidth expansion occurs.

Each scrambled and quantized $N_S$-length sequence $Q'_R(n)$ and $Q'_I(n)$ generated by masking circuit 36 is subsequently applied as a separate input to coefficient inserter 37, as illustrated in FIG. 2, which supplies the necessary number of coefficients to recreate sequences of length N denoted $Q'_R(n)$ and $Q'_I(n)$, respectively, from the above-defined $N_s$-length sequences $Q'_R(n)$ and $Q'_I(n)$. The insertion is accomplished in accordance with the same properties of Fourier transforms employed in association with coefficient selector 32, namely, that the real sequence $Q'_R(n)$ is evenly symmetric about N/2 and the imaginary sequence $Q'_I(n)$ is oddly symmetric about N/2, where the complex sum of the sequences $Q'_R(n)$ and $Q'_I(n)$ is defined as $X_s(n)$, the secure Fourier transform sequence. Like the above-described selection process, the insertion process may also be implemented with a microprocessor, which is programmed to: (a) read and store in separate files the $N_s$-length sequences $Q'_R(n)$ and $Q'_I(n)$, (b) insert sufficient zero elements into each file so that each sequence consists of N/2 elements, (c) generate N-length sequences, $Q'_R(n)$ and $Q'_I(n)$, from the N/2-length sequences in step (b) by employing the even and odd symmetry properties associated with $Q'_R(n)$ and $Q'_I(n)$, respectively, (i.e., $Q'_R(n)=Q'_R(N-n)=Q'_R(n)$ and $Q'_I(n)=-Q'_I(N-n)=Q'_I(n)$, for all $n=1,2,\ldots,N/2$), and (d) produce as an output the N-length sequences $Q'_R(n)$ and $Q'_I(n)$.

The output sequence $X_s(n)$ generated by scrambler 14, which, in accordance with the preferred embodiment illustrated in FIG. 2, comprises the real and imaginary scrambled sequences of length N generated by inserter 37, $Q'_R(n)$ and $Q'_I(n)$, respectively, are subsequently applied as separate inputs to inverse Fourier transform processor 16, which comprises in series an inverse fast Fourier transformer 38 and a weighting circuit 39. Inverse fast Fourier transformer (IFFT) 38, like fast Fourier transformer 31 described hereinbefore, may also be implemented with LSI devices, as discussed in the above-cited Schirm IV article.

In operation, the N-length sequences $Q'_R(n)$ and $Q'_I(n)$ are applied as separate inputs to IFFT 38 which transforms the sequences into its associated time domain sequence $x_s(n)$. The time-continuous secure analog signal, $x_s(t)$, which is transmitted by scrambling arrangement 10, is subsequently formed from the secure sequence by passing the sequence $x_s(n)$ through weighting circuit 39, which functions to "broaden" the duration of each element in the sequence and thereby form a continuous-time signal. One example of such a weighting function would simply be the well-known relation (sin x)/x. It is to be noted that the scrambling arrangement illustrated in FIG. 2 employing FFT 31 and IFFT 38 is exemplary only of a preferred embodiment of the present invention utilizing the advantages of the readily available FFT hardware. The present invention, however, is not limited in scope to only an FFT implementation, but may, in fact, employ any method of obtaining the Fourier transform of the input message signal and remain within the spirit and scope of the present invention.

Further, it is to be noted that the signal $x_s(t)$ produced by scrambler 10 possesses the same bandwidth as the original signal $x_a(t)$ since the scrambling was performed in the frequency domain. In particular, if the input signal was speech, bandlimited to the range 300 Hz to 3.4 KHz, the scrambled output signal $x_s(t)$ generated by transformer 16 will contain virtually no frequency component above 3.4 KHz, and therefore, $x_s(t)$ may be transmitted over, for example, a telephone channel comprising a 3.5 KHz bandwidth.

Figure 6:
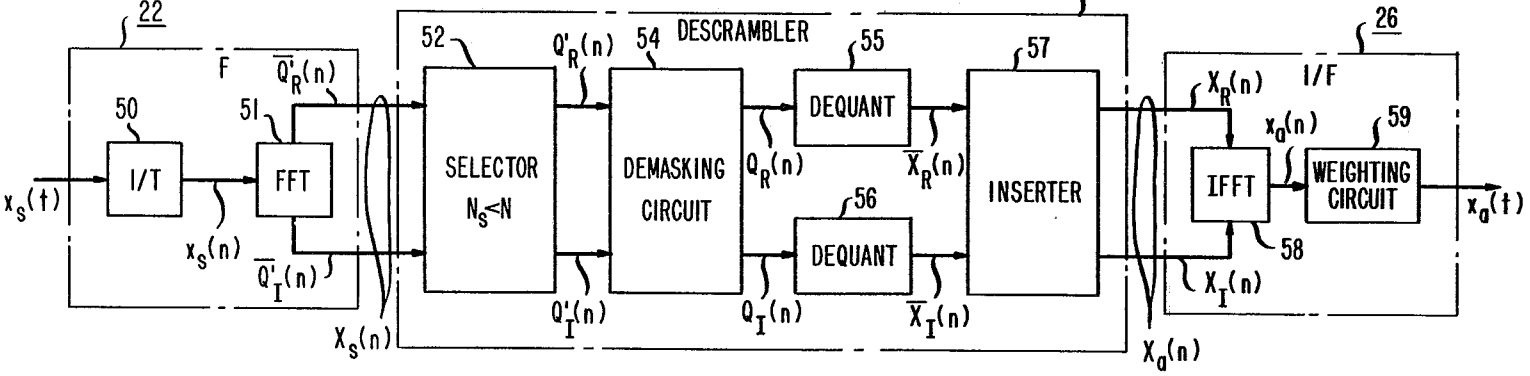
FIG. 6 illustrates a descrambling arrangement i.e., receiver, to be employed in association with the secure transmission system illustrated in FIG. 1, in accordance with the present invention.

As discussed hereinabove in association with FIG. 1, the scrambled analog signal $x_s(t)$ produced by the scrambling arrangement of FIG. 2 travels through the communication medium and is subsequently processed through descrambling arrangement 20 to be reconverted into the desired analog message signal, $x_a(t)$, where an exemplary descrambling arrangment, which is a preferred embodiment formed in accordance with the present invention, is illustrated in detail in FIG. 6. As seen by reference to FIG. 6, this descrambling process is similar in many respects to the scrambling process illustrated in FIG. 2, where this similarity is necessary to insure the accurate recovery of the message signal $x_a(t)$ from the secure signal $x_s(t)$. In operation, the received secure signal $x_s(t)$ is applied as an input to Fourier transform processor 22, which comprises in series a sampling circuit 50 and a fast Fourier transformer 51. Sampling circuit 50 samples the secure time domain signal $x_s(t)$ at a rate 1/T identical to the rate employed by sampling circuit 30 of FIG. 2, and produces an output sequence $x(n)=x_s(nT)$. A block of N samples of the sequence x(n) is subsequently applied as an input to fast Fourier transformer (FFT) 51, where transformer 51 may be implemented with LSI devices, as discussed hereinbefore in association with FFT 31 of FIG. 2. In accordance with the known symmetry properties of the FFT algorithm, as illustrated in FIG. 3, the output sequence $X_s(n)$ produced by fast Fourier transformer 51 of FIG. 6 comprises two distinct N-length sequences, an N-length real sequence evenly symmetric about the value N/2 and an N-length imaginary sequence oddly symmetric about N/2. Moreover, the two sequences of N coefficients generated by fast Fourier transformer 51 will be approximately identical to the output sequences generated by coefficient inserter 37 of FIG. 2, specifically, $Q'_R(n)$ and $Q'_I(n)$, since the cascaded IFFT and FFT processes of transformers 38 and 51 of FIGS. 2 and 6, respectively, will function to cancel each other out.

The real and imaginary N-length sequences $Q'_R(n)$ and $Q'_I(n)$ produced by transformer 51 are subsequently applied as separate inputs to a coefficient selector 52, where coefficient selector 52 performs the same function as coefficient selector 32 of FIG. 2 and hence, may also be implemented by a microprocessor, as discussed hereinabove in association with selector 32 of FIG. 2. More particularly, selector 52 deletes, for example, the first N/2 coefficients of each sequence which contain the same information as the remaining N/2 coefficients and further, selector 52 will delete any remaining coefficients which contain no additional information, as briefly discussed hereinbefore in association with selector 32, to form real and imaginary sequences of length $N_s$, where $N_s \leqq N/2$. Additionally, this selection process performed by selector 52 on the sequences $Q'_R(n)$ and $Q'_I(n)$ may be viewed as the inverse of the insertion process performed by inserter 37 of FIG. 2, and therefore, the output sequences produced by selector 52 are approximately identical to the sequences $Q'_R(n)$ and $Q'_I(n)$, the input sequences to inserter 37, as defined hereinabove in association with FIG. 2.

The sequences $Q'_R(n)$ and $Q'_I(n)$ produced by selector 52 are subsequently applied as separate inputs to a demasking circuit 54, where demasking circuit 54 performs the conjugate operation of masking circuit 36 of FIG. 2 to "de-mask" the sequences $Q'_R(n)$ and $Q'_I(n)$, thereby generating output sequences approximately identical to the sequences applied as inputs to masking circuit 36, specifically, the sequences $Q_R(n)$ and $Q_I(n)$. In particular, if masking circuit 36 is of the form illustrated in FIG. 5, demasking circuit 54 would comprise a similar arrangement, but would include modulo-M subtractors instead of the modulo-M adders illustrated in FIG. 5. Demasking circuit 54, therefore, would perform element-by-element modulo-M subtraction of the $N_s$-length sequence $S_R$ from the $N_S$-length input sequence $Q'_R(n)$, and modulo-M subtraction of the $N_s$-length sequence $S_I$ from the $N_s$-length input sequence $Q'_I(n)$. It must be noted that the masking sequences $S_R$ and $S_I$ employed by demasking circuit 54 must be identical to the masking sequences employed by masking circuit 36, and further, these sequences must be synchronized by any method known in the art, as for example, the method disclosed in the abovecited Baxter reference, in order to accurately recover the original signal from the scrambled version.

The output sequences $Q_R(n)$ and $Q_I(n)$ produced by demasking circuit 54 are subsequently applied as separate inputs to dequantizers 55 and 56, respectively, which perform the inverse function of quantizers 33 and 34 of FIG. 2. More particularly, dequantizers 55 and 56, which may also be implemented with a ROM, as discussed hereinbefore in association with quantizers 33 and 34, map the sequences of level numbers 0 through M-1 back into the Fourier coefficient domain, where dequantizers 55 and 56 employ the inverse mapping function as quantizers 33 and 34 of FIG. 2. Specifically, a similar "look-up" table to that discussed hereinabove in association with quantizers 33 and 34 of FIG. 2 may be employed, where the inputs and outputs to the ROM are reversed so that a given quantization level will "look-up" its associated Fourier coefficient. Therefore, the output sequences produced by dequantizers 55 and 56 will be approximately equal to the sequences applied as inputs to quantizers 33 and 34 of FIG. 3, specifically, $X_R(n)$ and $X_I(n)$.

In order to recover the N-length sequences $X_R(n)$ and $X_I(n)$ from their respective $N_s$-length sequences, $X_R(n)$ and $X_I(n)$ generated by dequantizers 55 and 56, the latter sequences are applied as separate inputs to a coefficient inserter 57. Coefficient inserter 57, which performs the inverse operation of coefficient selector 32 of FIG. 2, inserts the necessary coefficients into each sequence to transform the $N_s$-length sequence $X_R(n)$ into an N-length sequence, $X_R(n)$, evenly symmetric about the value N/2, and $N_s$-length sequence $X_I(n)$ into an N-length sequence, $X_I(n)$, oddly symmetric about the value N/2. In particular, inserter 57 functions in a like manner as inserter 37 of FIG. 2, and therefore, a microprocessor programmed as discussed hereinabove in reference to inserter 37 may be viewed as an exemplary method of obtaining the inserted values.

The desired analog signal $x_a(t)$ may therefore be recovered by applying the Fourier sequences $X_R(n)$ and $X_I(n)$ produced by inserter 57 as inputs to inverse Fourier transform processor 26, where inverse Fourier transform processor comprises in series an inverse fast Fourier transformer (IFFT) 58 and a weighting circuit 59. Inverse fast Fourier transformer 58, like the other fast Fourier transformers described hereinbefore, may also be implemented with LSI devices. In operation, the N-length sequences $X_R(n)$ and $X_I(n)$ are applied as separate inputs to IFFT 58, which transforms the sequences into its associated time domain message sequence $x_a(n)$. The time-continuous analog message signal, $x_a(t)$, which is recovered by descrambling arrangement 20, is subsequently formed by passing the message sequence $x_a(n)$ through weighting circuit 59, which functions to "broaden" the duration of each element in the sequence and thereby form a continuous-time signal, in this case, the message signal $x_a(t)$. One example of such a weighting function would simply be the relation (sin x)/x.

I claim:

1. In a secure communication system for analog communication signals:

a scrambling arrangement (10) capable of receiving as an input a time domain analog message communication signal ($x_a(t)$) and producing as an output signal a secure time domain analog communication signal ($x_s(t)$) related to said input message signal, and a descrambling arrangement (20) capable of receiving as an input said secure time domain analog communication signal produced by said scrambling arrangement and transforming said secure signal back into said input time domain analog message communication signal characterized in that the scrambling arrangement includes:

a Fourier transform processor (12) capable of generating as an output a Fourier transform frequency domain signal ($X_a(n)$) related to the input time domain analog message communication signal;

scrambling means (14) capable of encoding said Fourier transform frequency domain signal produced by said Fourier transform processor to produce as an output a secure Fourier transform frequency domain signal ($X_s(n)$); and an inverse Fourier transform processor (16) capable of transforming said secure Fourier transform frequency domain signal produced by said scrambling means into the secure time domain analog communication signal ($x_s(t)$); and the descrambling arrangement includes:

a Fourier transform processor (22) capable of receiving as an input said secure time domain analog communication signal produced by said scrambling arrangement and generating as an output a secure Fourier transform frequency domain signal ($X_s(n)$) corresponding to said secure Fourier transform frequency domain signal produced by said scrambling means;

descrambling means (24) capable of decoding said secure Fourier transform frequency domain signal produced by said descrambling arrangement Fourier transform processor to produce as an output a Fourier transform frequency domain signal ($X_a(n)$) corresponding to said Fourier transform frequency domain signal produced by said scrambling arrangement Fourier transform processor; and an inverse Fourier transform processor (26) capable of transforming said Fourier transform frequency domain signal produced by said descrambling means into the time domain analog message communication signal ($x_a(t)$).

2. A scrambling arrangement (10) capable of forming and transmitting a secure time domain analog signal ($x_s(t)$) which is an encoded adaptation of an input time domain analog message signal ($x_a(t)$)

characterized in that the scrambling arrangement comprises:

a Fourier transform processor (12) capable of generating as an output a Fourier transform frequency domain signal ($X_a(n)$) related to the input time domain analog message signal;

scrambling means (14) capable of encoding said Fourier transform frequency domain signal produced by said Fourier transform processor to produce as an output a secure Fourier transform frequency domain signal ($X_s(n)$); and an inverse Fourier transform processor (16) capable of transforming said secure Fourier transform frequency domain signal produced by said scrambling means into the secure time domain analog communication signal ($x_s(t)$).

3. A scrambling arrrangement formed in accordance with claims 1 or 2 characterized in that the scrambling arrangement Fourier transform processor comprises:

sampling means (30) capable of sampling the input analog message communication signal ($x_a(t)$) at a predetermined rate (1/T) and producing as an output a sequence ($x_a(n)$) comprising sampled elements of said input analog message communication signal; and a fast Fourier transformer (31) capable of operating on every group of N sampled elements of said sequence produced by said sampling means and generating as simultaneous output sequences both an N-length real Fourier coefficient sequence ($X_R(n)$) and an N-length imaginary Fourier coefficient sequence ($X_I(n)$), said real N-length Fourier coefficient sequence being evenly symmetric about a value N/2 and said imaginary N-length Fourier coefficient sequence being oddly symmetric about said value N/2;

the scrambling means is capable of receiving as separate simultaneous inputs both said real and imaginary N-length Fourier coefficient sequences and producing as separate output sequences an N-length secure quantized real Fourier coefficient sequence ($Q'_R(n)$) associated with said real Fourier coefficient sequence and an N-length secure quantized imaginary Fourier coefficient sequence ($Q'_I(n)$) associated with said imaginary Fourier coefficient sequence; and the scrambling arrangement inverse Fourier transform processor comprises:

an inverse fast Fourier transformer (38) capable of receiving as separate simultaneous inputs said real and imaginary secure quantized N-length Fourier coefficient sequences produced by said scrambling means and transforming said real and imaginary secure quantized N-length Fourier coefficient sequences into a secure time domain sequence ($x_s(n)$); and weighting means (39) responsive to said secure time domain sequence produced by said scrambling arrangement inverse fast Fourier transformer for multiplying said sequence by a predetermined weighting function to produce as an output the secure analog communication signal ($x_s(t)$).

4. A scrambling arrangement formed in accordance with claim 3 characterized in that the scrambling means comprises:

coefficient selector means (32) responsive to both the real and imaginary N-length Fourier coefficient sequences produced by the scrambling arrangement fast Fourier transformer and capable of selecting a predetermined subset $N_s$ of each set of N coefficients and producing as an output both an $N_s$-length real Fourier coefficient sequence ($X_R(n)$) and an $N_s$-length imaginary Fourier coefficient sequence ($X_I(n)$, where $N_s \leqq N/2$;

quatizing means (33, 34) capable of receiving as separate inputs both said real and imaginary $N_s$-length Fourier coefficient sequences produced by said coefficient selector means and capable of producing as separate outputs both an $N_s$-length quantized real Fourier coefficient sequence ($Q_R(n)$) and an $N_s$-length quantized imaginary Fourier coefficient sequence ($Q_I(n)$); and masking means (36) capable of receiving as separate inputs said $N_s$-length quantized real and imaginary Fourier coefficient sequences produced by said quantizing means and separately encoding each $N_s$-length quantized sequence to produce as separate outputs an $N_s$-length secure quantized real Fourier coefficient sequence ($Q'_R(n)$) and an $N_s$-length secure quantized imaginary Fourier coefficient sequence ($Q'_I(n)$), wherein each secure sequence comprises a set of $N_s$ statistically independent elements; and coefficient insertion means (37) capable of receiving as separate inputs said quantized real and quantized imaginary $N_s$-length secure sequences produced by said masking means and capable of inserting a sufficient number of predetermined sequence elements into each secure sequence to form the real and imaginary N-length secure quantized Fourier coefficient sequences ($Q'_R(n)$, $Q'_I(n)$), respectively, produced by the scrambling means.

5. A descrambling arrangement capable of receiving a secure time domain analog communication signal ($x_s(t)$) related to a Fourier transform of a time domain analog message communication signal ($x_a(t)$) and decoding said secure analog signal to reform said analog message communication signal characterized in that the descrambling arrangement comprises:

a Fourier transform processor (22) capable of receiving as an input the secure time domain analog communication signal and generating as an output a secure Fourier transform frequency domain signal ($X_s(n)$) corresponding to said secure time domain analog communication signal;

descrambling means (24) capable of decoding said secure Fourier transform frequency domain signal generated by said Fourier transform processor to produce as an output a Fourier transform frequency domain signal ($X_a(n)$); and an inverse Fourier transform processor (26) responsive to said Fourier transform frequency domain signal produced by said descrambling means and capable of transforming said Fourier transform frequency domain signal into the time domain analog message communication signal.

6. A descrambling arrangement formed in accordance with claims 1 or 5 characterized in that the descrambling arrangement Fourier transform processor comprises:

sampling means (50) capable of sampling the secure analog communication signal ($x_s(t)$) at a predetermined rate (1/T) and producing as an output a sequence ($x_s(n)$) comprising sampled elements of said secure analog communication signal; and a fast Fourier transformer (51) capable of receiving as an input N elements of said sequence produced by said sampling means and generating as simultaneous output sequences both a secure quantized N-length real Fourier coefficient sequence ($Q'_R(n)$) and a secure quantized N-length imaginary Fourier coefficient sequence ($Q'_I(n)$), said secure quantized real Fourier coefficient sequence being evenly symmetric about a value N/2 and said secure quantized imaginary Fourier coefficient sequence being oddly symmetric about said value N/2; and the descrambling means is capable of receiving as separate simultaneous inputs both said real and imaginary secure quantized Fourier coefficient sequences and producing as separate output sequences a real N-length Fourier coefficient sequence ($X_R(n)$) associated with said secure quantized real sequence and an imaginary N-length Fourier coefficient sequence ($X_I(n)$) associated with said secure quantized imaginary sequence; and the descrambling arrangement inverse Fourier transform processor comprises:

an inverse fast Fourier transformer (58) capable of receiving as separate simultaneous inputs said real and imaginary N-length Fourier coefficient sequences produced by said descrambling means and Fourier transforming said N-length sequences to form an analog message sequence ($x_a(n)$); and weighting means (59) responsive to said analog message sequence produced by said descrambling arrangement inverse fast Fourier transformer and capable of multiplying said message sequence by a predetermined weighting function to produce as an output the analog message communication signal ($x_d(t)$).

7. A descrambling arrangement formed in accordance with claim 6 characterized in that the descrambling means comprises:

coefficient selection means (52) responsive to both the real and imaginary secure quantized N-length Fourier coefficient sequences produced by the descrambling arrangement fast Fourier transformer and capable of selecting a predetermined subset $N_s$ of each sequence of N coefficients and producing as an output both a secure $N_s$-length real quantized Fourier coefficient sequence ($Q'_R(n)$) and a secure $N_s$-length imaginary quantized Fourier coefficient sequence ($Q'_I(n)$), where $N_s \leqq N/2$;

demasking means (54) capable of receiving as separate inputs said real and imaginary $N_s$-length secure quantized Fourier coefficient sequences produced by said coefficient selection means and separately decoding each $N_s$-length sequence to form its associated $N_s$-length quantized message sequence and producing as an output a real $N_s$-length quantized Fourier coefficient sequence ($Q_R(n)$) and an imaginary $N_s$-length quantized Fourier coefficient sequence ($Q_I(n)$);

dequantizing means (55, 56) capable of receiving as separate inputs both said real and imaginary $N_s$-length quantized Fourier coefficient sequences produced by said demasking means and capable of producing as separate outputs both an $N_s$-length real Fourier coefficient sequence ($X_R(n)$) and an $N_s$-length imaginary Fourier coefficient sequence ($X_I(n)$); and coefficient insertion means (57) capable of receiving as separate inputs said $N_s$-length real and imaginary Fourier coefficient sequences produced by said dequantizing means and inserting a sufficient number of predetermined sequence elements into each $N_s$-length sequence to form the real N-length Fourier coefficient sequence ($X_R(n)$) and the imaginary N-length Fourier coefficient sequence ($X_I(n)$) produced by said descrambling means.

8. A method of achieving secure transmission of a time domain analog message signal ($x_d(t)$) comprising the steps of:

a. scrambling said time domain analog message signal to form a secure time domain analog signal ($X_s(t)$), b. transmitting the secure time domain analog signal;

characterized in that the method comprises the further steps of:

c. in performing step (a), performing the steps of:

1. transforming the analog message signal ($x_d(t)$) into its associated N-length message Fourier coefficient frequency domain sequence ($X_d(n)$);

2. coding the result of step (c)(1) to form an N-length secure Fourier coefficient frequency domain sequence ($X_s(n)$); and 3. inverse-transforming the result of step (c)(2) to form the secure time domain analog signal ($x_s(t)$).

9. The method according to claim 8 characterized in that the method comprises the further steps of:

d. in performing step (c)(1), performing the steps of:

1. sampling the analog message signal at a predetermined rate (1/T) to form a message sequence ($X_d(n)$); and 2. fast Fourier transforming the result of step (d)(1) to form both an N-length real Fourier coefficient sequence ($X_R(n)$) and an N-length imaginary Fourier coefficient sequence ($X_I(n)$), said N-length real and imaginary sequences corresponding to the N-length message Fourier coefficient sequence ($X_d(n)$);

e. in performing step (c)(2) separately coding each N-length sequence resulting from step (d)(2) to form both an N-length secure real Fourier coefficient sequence ($Q'_R(n)$) and an N-length secure imaginary Fourier coefficient sequence ($Q'_I(n)$); and f. in performing step (c)(3), performing the steps of:

1. inverse fast Fourier transforming the result of step (e) to form a secure sequence ($X_s(n)$); and 2. weighting the result of step (f)(1) to form the secure analog message signal ($x_s(t)$).

10. A method of achieving reception of a secure analog signal ($x_s(t)$) related to a Fourier transform of an analog message signal and recovering said analog message signal therefrom comprising the steps of:

a. receiving the secure analog signal; and b. descrambling the received secure analog signal to recover the original analog message signal $x_d(t)$ characterized in that the method comprises the further steps of:

c. in performing step (b), performing the steps of:

1. transforming the received secure analog signal ($x_s(t)$) into its associated N-length secure Fourier coefficient sequence ($X_s(n)$);

2. decoding the result of step (c)(1) to recover the original N-length Fourier coefficient sequence ($X_d(n)$); and 3. inverse-transforming the result of step (c)(2) to form the analog message signal $x_d(t)$.

11. The method according to claim 10 characterized in that the method comprises the further steps of:

d. in performing step (c)(1), performing the steps of:

1. sampling the secure analog signal at a predetermined rate (1/T) to form a secure message sequence ($x_s(n)$); and 2. fast Fourier transforming the result of step (d)(1) to form both an N-length secure real Fourier coefficient sequence ($Q'_R(n)$) and an N-length secure imaginary Fourier coefficient sequence ($Q_I(n)$) said N-length secure real and secure imaginary sequences corresponding to the N-length secure Fourier coefficient sequence ($X_s(n)$);

e. in performing step (c)(2) separately decoding each N-length sequence resulting from step (d)(2) to form both an N-length real Fourier coefficient sequence ($X_R(n)$) and an N-length imaginary Fourier coefficient sequence ($X_I(n)$); and f. in performing step (c)(3) performing the steps of:

1. inverse fast Fourier transforming the result of step (e) to form a message sequence ($X_d(n)$); and 2. weighting the result of step (f)(1) to form the analog message signal $x_d(t)$

* * * * *